United States Patent [19]

Robinette

[11] Patent Number: 4,529,333

[45] Date of Patent: Jul. 16, 1985

[54] UNDERWATER AIR VALVE ASSEMBLY

[76] Inventor: Lloyd T. Robinette, 15225 S. Main St., Gardena, Calif. 90247

[21] Appl. No.: 570,863

[22] Filed: Jan. 16, 1984

[51] Int. Cl.[3] ..... B63C 11/22

[52] U.S. Cl. ..... 405/186; 441/92; 441/96

[58] Field of Search ..... 405/86; 128/201.27, 128/202.14; 137/596.2; 441/92, 96, 108, 117, 118

[56] References Cited

U.S. PATENT DOCUMENTS

| | | | |
|---|---|---|---|
| 3,536,071 | 10/1970 | Ferrando | 441/118 X |
| 3,898,705 | 8/1975 | Schuler | 405/186 |
| 4,016,616 | 4/1977 | Walters | 405/186 X |
| 4,211,254 | 7/1980 | Dyal | 137/596.2 X |
| 4,227,521 | 10/1980 | Hart et al. | 128/202.14 |

FOREIGN PATENT DOCUMENTS

| | | | |
|---|---|---|---|
| 2084881 | 4/1982 | United Kingdom | 405/186 |

*Primary Examiner*—Dennis L. Taylor

*Attorney, Agent, or Firm*—Matthew P. Lynch

[57] ABSTRACT

An underwater air valve assembly which is to be connected to an air inflatable vest worn by a diver. The air valve assembly is located within a housing, which in turn, has a depth gauge and a pressure gauge mounted thereon. The housing is connected through a flexible hose to the air inflatable vest. A separate conduit extending from the pressurized air tank worn by the diver is located within the hose. The conduit is connected through a connecting conduit to a manually operated first valve, which when operated, will cause conducting of pressurized air from the conduit into the hose and hence into the inflatable vest. A second manually operated valve is mounted within the housing and when moved to the open position causes conducting of air from the hose to the ambient. A second valve assembly can also be utilized in conjunction with an oral inflation passage for the conducting of pressurized air orally into the hose and hence into the inflatable vest.

9 Claims, 10 Drawing Figures

UNDERWATER AIR VALVE ASSEMBLY

BACKGROUND OF THE INVENTION

The field of this invention relates to scuba equipment, and more particularly to a valve assembly for connection between breathing air tanks and an inflatable life vest worn by the driver.

Conventional scuba equipment utilizes a pressurized air source in the form of a tank assembly, a breathing mouthpiece, an inflatable life vest, a pressure gauge connected to the air tank assembly for ascertaining the quantity of air remaining in the air tank assembly and a depth gauge used by the diver to determine the underwater depth. Typically the mouthpiece is connected through a conduit to the air tank assembly. The inflatable life vest is connected through a separate hose to a valve assembly which, when operated, can either result in oral inflation of the life vest or discharge of pressurized air from the life vest. There is also a separate conduit connection between the air tank assembly and the pressure gauge.

As a result, there is a substantial amount of different equipment which is carried by the diver. There is a separate pressure gauge and a separate conduit connecting the pressure gauge to the air tank. There is also the hose connecting the inflation jacket to the valve which can be operated to inflate or deflate the inflation jacket. Further, the diver must wear a separate depth gauge.

It would be desirable if some structure could be utilized to condense this equipment so that the diver would be required to carry less equipment.

SUMMARY OF THE INVENTION

The structure of this invention utilizes a housing constructed of a hard rubber or plastic material. The housing includes exterior recesses, one of which is to facilitate location of a pressure gauge and the other which is to facilitate location of a depth gauge. The housing is to include a connector which is connected to a flexible hose. The flexible hose is in turn connected to an inflation jacket which is worn by the diver. Within the flexible hose is located a conduit which is connected to the breathing tanks which are worn by the diver. The free end of the conduit is in turn connected to the pressure gauge. A separate connecting conduit connects the conduit to a manually operated first valve assembly. Operation of the manually operated first valve assembly will cause pressurized air from the conduit to be conducted into the hose. The first valve assembly is mounted within the housing. There is included within the housing a second valve assembly. The second valve assembly is capable of occupying a closed position, a partially open position and a completely open position. When the second valve assembly is in the closed position, no air flow is conducted therethrough. With the second valve assembly in a partially open position, air flow is to be conducted from the hose into the ambient. With the second valve assembly in the completely open position, orally supplying of pressurized air into the hose and hence into the inflation jacket is possible. This oral inflation is facilitated by the forming of a mouthpiece section with the housing.

The primary objective of the present invention is to construct an apparatus to be utilized by divers which combines different types of diving equipment thereby eliminating the need for using separate pieces of equipment.

Another objective of this invention is to enhance safety by combining buoyancy control and ability to monitor the pressure and depth gauge within easy reach by the diver.

DETAILED DESCRIPTION OF THE SHOWN EMBODIMENT

Figure 1:
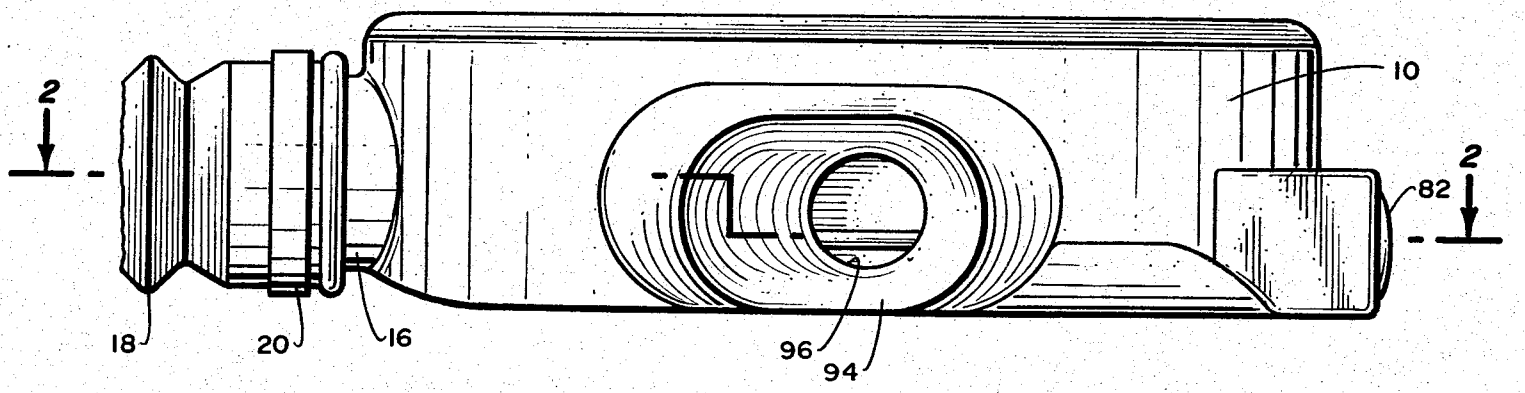
FIG. 1 is a side elevational view of the underwater air valve assembly of this invention.

Referring particularly to the drawings, there is shown a rubber housing 10 which has been formed to include an internal chamber 12, which in turn connects to an enlarged passage 14 which is located within a connector sleeve 16. The end of a flexible hose 18 is fixedly secured to the exterior surface of the connector 16 by means of securing band 20. The elongated internal chamber 22 of the hose 18 is to connect with an inflation vest (not shown). The housing 10 is to be mounted directly on the vest preferably through the use of a readily disengageable fastening assembly such as is sold under the tradename of "Velcro".

Formed within the exterior upper wall of the housing 10 are a pair of recesses 30 and 32. Mounted within the recess 30 is a conventional pressure gauge 34. The pressure gauge 34 includes a pointer 36 which is to move across a scale 38 to affect reading of the amount of pressure within the air breathing tank assembly (not shown) which is worn on the back of the diver. The function of the pressure gauge 34 is so the diver can quickly ascertain exactly how much air remains within the breathing tank assembly. The construction of the gauge 34 may be either mechanical, electronic, analog or digital.

The pressure gauge 34 is connected through a fitting assembly 40 to a conduit 42. The conduit 42 is located within the elongated internal chamber 22 of the hose 18. The inner end of the conduit 42 is fixed to a sleeve 41. The sleeve 41 has a passage 43. Found within sleeve 41 is an opening 45. A plug 47 is swivelly mounted within opening 45. Plug 47 includes passage 49 which is in continuous connection with passage 43. Passage 51 also continuously connects with passage 49.

Plug 47 is threadably secured within connecting sleeve 53. Hose 18 is attached to sleeve 53 by band 55. A separate length of hose 57 is attached by band 59 to sleeve 53. Hose 57 is connected to a buoyancy system (not shown) such as a life vest (not shown).

Plug 47 extends exteriorly of sleeve 53. Plug 47 has a male fitting 61 extending therefrom. Fitting 61 connects to female fitting 63 of a quick-disconnect coupling 65. Coupling 65 includes a manually movable sleeve 67. Sleeve 67 connects with balls 69 which are to extend radially inward to secure coupling 65 to male fitting 61. Sleeve 67 is movable to a retracted position exposing balls 69 permitting disengagement of coupling 65 from fitting 61. Coupling 65 is to be connected through a hose (not shown) to the air breathing apparatus (source of high pressure gas) worn by the diver. It is to be noted that plug 47 can be swivelled to any desired orientation relative to sleeve 53 to orient the coupling 65 in a particular desired direction to accommodate connection to the air breathing apparatus.

For purposes of convenience, it is desirable to include a depth gauge 44 so that the diver will not go a depth greater than is desired. The depth gauge 44 is located within the recess 32. The construction of the depth gauge 44 is deemed to be conventional and also includes a pointer 46 which pivots across a scale 48. It is understood that the scale 48 will include appropriate indicia so the diver can readily ascertain his or her depth in the water. It is also understood that the scale 38 also includes appropriate indicia for determining the air pressure within the breathing tank assembly. It is further understood that the depth gauge 44 is sensitive to the pressure within the water. Also, the gauge 44 may be constructed to be mechanical, electronic, analog or digital.

Mounted within opening 50 within the back side of the housing 10 is a valve housing 52. The valve housing 52 includes a center opening 54 within which there is slidably mounted a valve plunger 56. The valve plunger 56 is movable between a retracted position shown in FIGS. 2 and 3 of the drawings, to an extended position (not shown). The plunger 56 is normally held in retracted position by means of a spring 58 which operates against enlarged head 60 of the plunger 56. The plunger 56 includes a first bleed passage 62. The sleeve 52 includes a second bleed passage 64. The second bleed passage is connected through a connecting conduit 66 to the fitting assembly 40 and hence to the air pressure contained within the conduit 42.

Movement of the plunger 56 to the extended position which causes the head 60 to come into contact with the outermost portion of the housing 52 and compressing of the spring 58 will result in one end of the bleed passage 62 connecting with the bleed passage 64. This causes air pressure to be conducted from hose 42 through the passages 64 and 62 and into small chamber 68 formed within the inner end of the valve housing 52. The small chamber 68 is connected directly to internal chamber 12. As a result, pressurized air is conducted through the elongated internal chamber 22 and hose 57 into the inflation jacket (not shown) worn by the diver, thereby making the diver more buoyant. Normally, the diver will only momentarily strike enlarged head 60 in short bursts to increase the buoyancy of the life jacket to the desired level.

As the diver moves to different depths, it is necessary to alter the amount of inflation of the life jacket. Upon moving to a more shallow depth, it is necessary for the diver to remove some of the air pressure from the life jacket in order to remain at that depth and not rise to the surface. In order to accomplish this, there is provided a second valve assembly mounted within the housing. The second valve assembly includes a plunger 70 which is movably mounted within an elongated opening 72 formed within the housing. The inner end of the plunger is attached to a disc 74. The disc 74 is held in place on the plunger 70 by means of a nut 76 which is threaded onto the plunger 70 and abutts against the disc 74. The inner surface of the disc 74 will normally rest against a collar 78. The collar 78 includes an opening 80. The disc 74 and the nut 76 are located within the internal chamber 12. The opening 80 connects with the internal chamber 12.

The outer end of the plunger 70 is attached to an enlarged head 82. The inner surface of the enlarged head 82 rests against a coil spring 84. Enlarged head 82 is located between a pair of protuberances 86 and 88 which are formed as part of the housing 10. The reason for the nesting of the enlarged head 82 between the protuberances 86 and 88 is to minimize the possibility of accidental contact with the head 82 and accidental operation of the second valve assembly. The inner coil of the coil spring 84 abutts against a shoulder 90 of a coil spring receiving chamber 92 formed within the housing 10.

Figure 2:
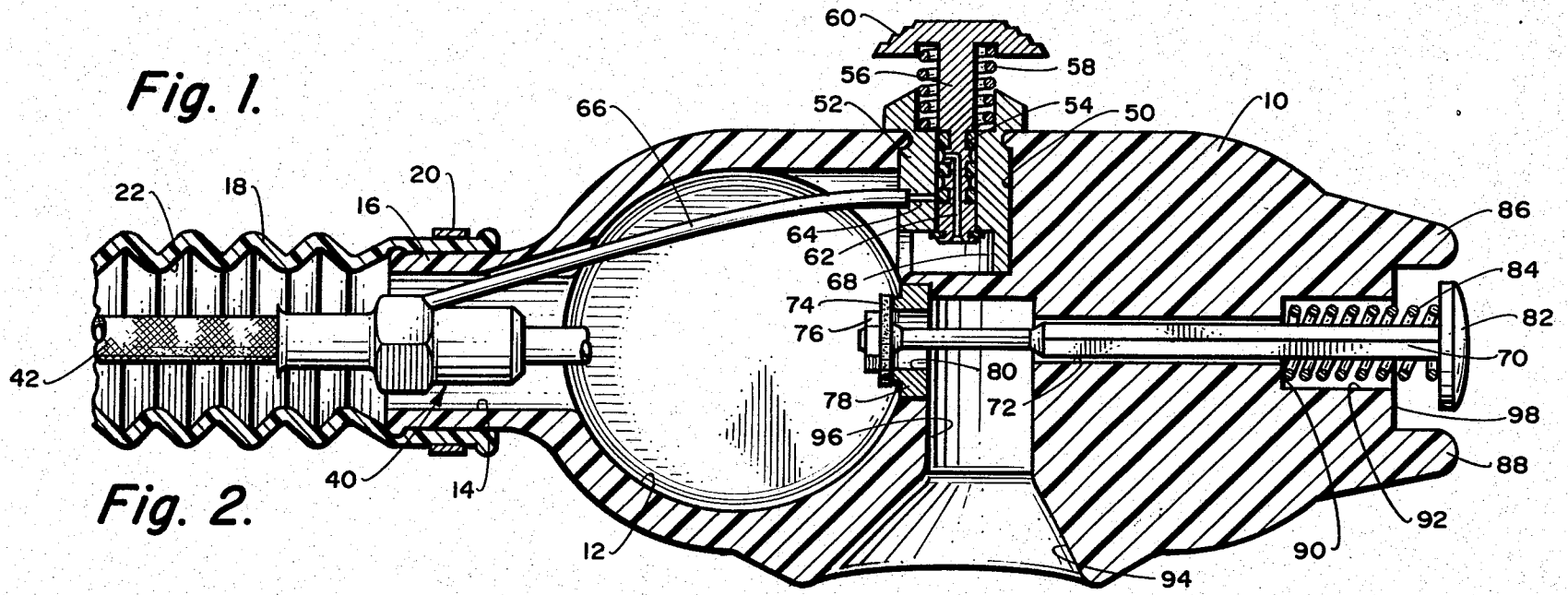
FIG. 2 is a cross-sectional view taken along line 2—2 of FIG. 1.
Figure 3:
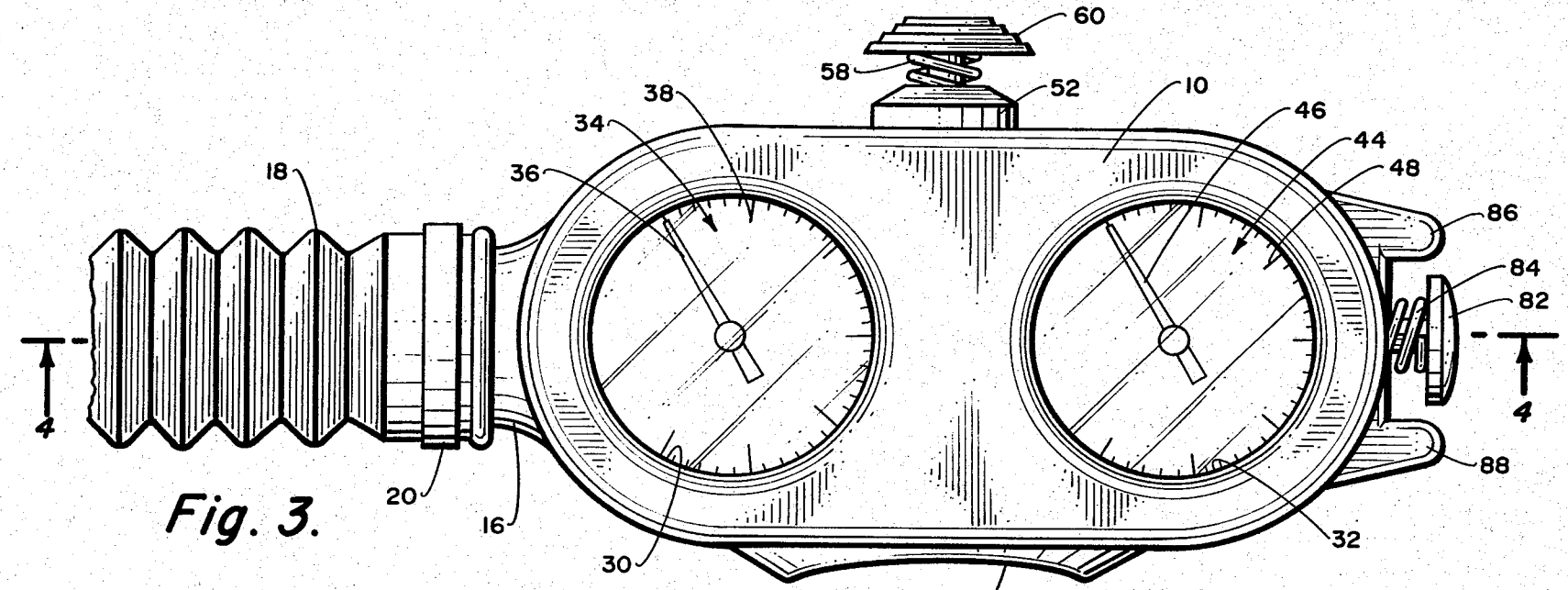
FIG. 3 is a top plan view of the underwater air valve assembly of this invention in its normal observable position for reading of the depth and pressure gauges mounted within the underwater air valve assembly of this invention.
Figure 4:
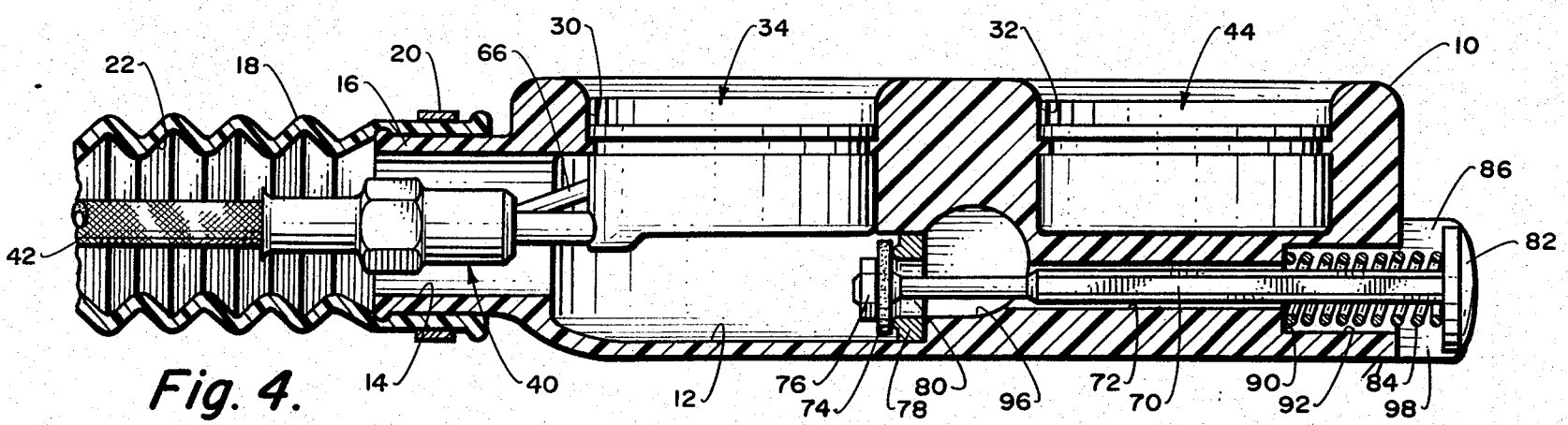
FIG. 4 is a cross-sectional view taken along line 4—4 of FIG. 3.

Referring particularly to FIGS. 2 and 4 of the drawings, the second valve assembly is shown in the closed position which prevents pressurized air from being conducted from the chamber 12 through the opening 80 and through the elongated opening 72 past the enlarged head and into the ambient. However, slight movement of the head 82 will result in the second valve assembly assuming a partially open position. This will cause the air from the chamber 12 to be conducted through the opening 80, with at least some of this air being conducted through the opening 72 and past the enlarged head 82 into the ambient. Therefore, release of air pressure within the inflated jacket has occured and the buoyancy of the diver is decreased.

In certain instances, it may be desirable to increase the air in the inflatable jacket without using the first valve assembly, especially if the quantity of air within the tanks is at low level and it is desirable to keep such available for breathing. In order to achieve this inflating of the inflatable jacket without utilizing the first valve assembly, the diver only needs to place his mouth against mouthpiece conforming opening 94 which is formed within the housing 10. The operator can then blow slightly which will cause the water contained within the air passage 96 to be moved up through the elongated opening 72 past the plunger 70, through the spring receiving opening 92 and into the ambient. When the operator senses that the water has been substantially removed, the operator then presses the enlarged head 82 until the inner surface of such contact shoulder 98. This closes the spring receiving opening 92 and enlarged opening to the ambient and at the same time, opens air passage 96 to the internal chamber 12. Therefore, air pressure created by the diver blowing will be conducted through the chamber 22 of the hose 18 into the inflatable vest to increase the buoyancy of the vest.

It has been found that it may be desirable to include some type of restrictor to restrict the flow of high pressure gas from the air breathing apparatus prior to entering into the hose 42. The restrictor would appear to be desirable at times when the air breathing apparatus is pressurized to maximum pressure. At times when the air breathing apparatus is reaching the level of minimum pressure, a restriction is not necessary.

Figure 5:
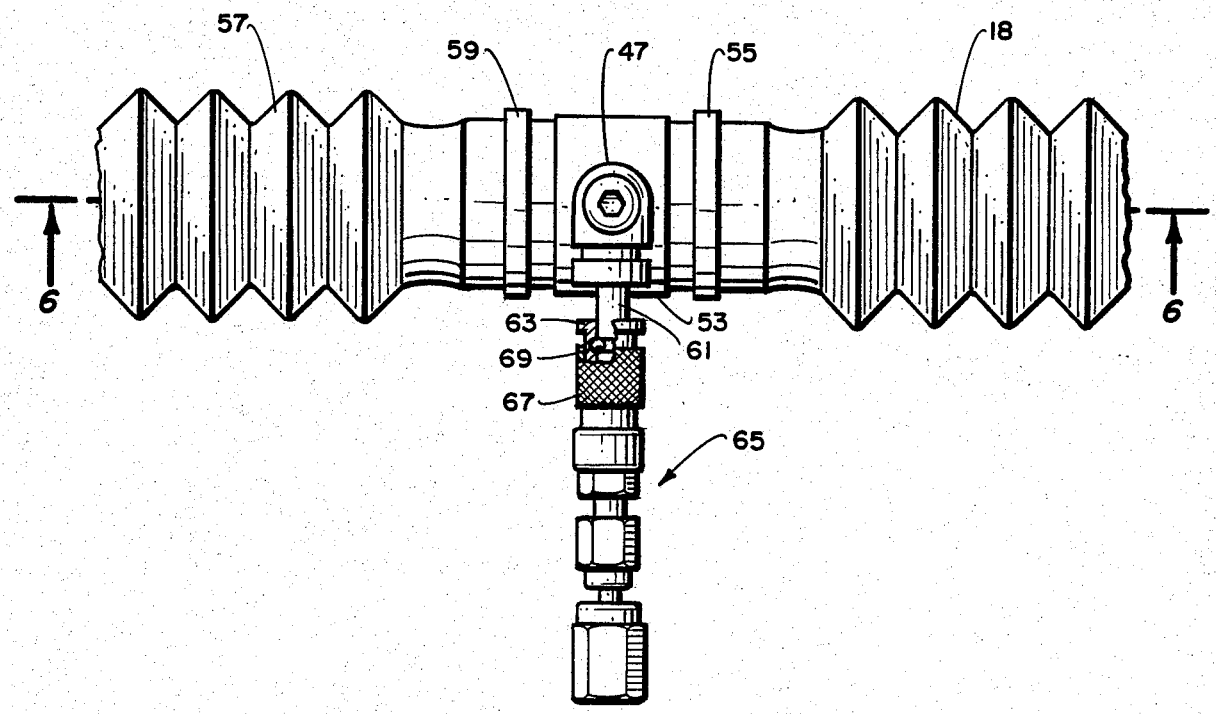
FIG. 5 is a top plan view of a quick-disconnect fitting assembly utilized to connect the high pressure line to the underwater air valve assembly of this invention.
Figure 6:
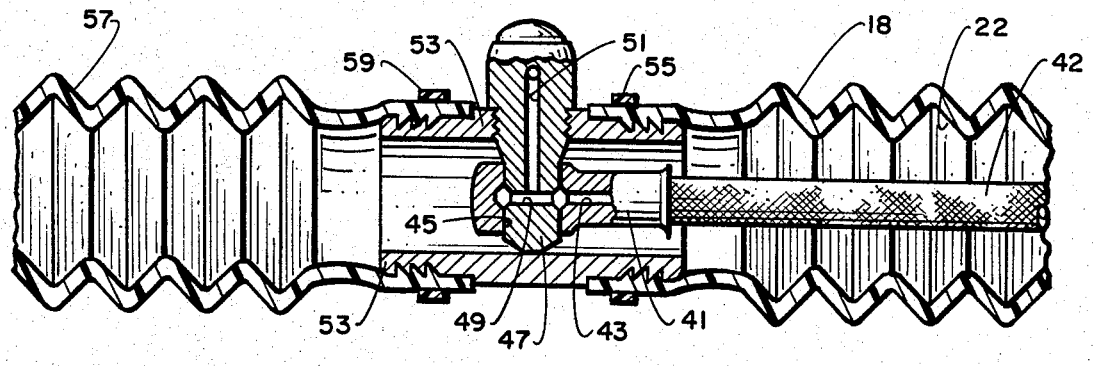
FIG. 6 is a cross-sectional view taken along line 6—6 of FIG. 5.
Figure 7:
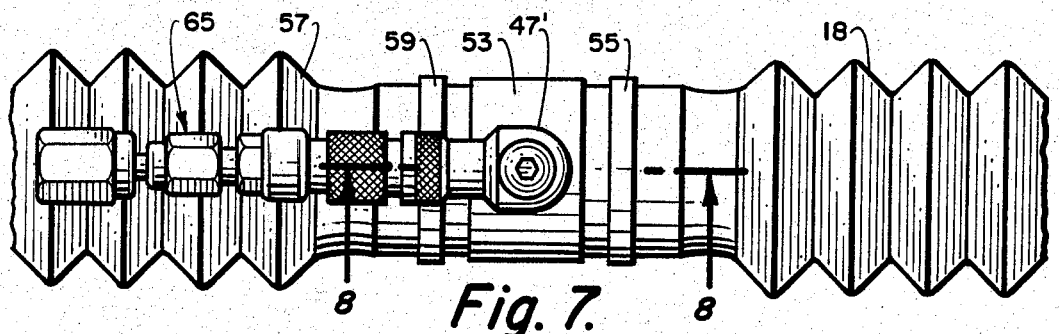
FIG. 7 is a top plan view similar to FIG. 5 but of a modified form of fitting assembly which is used to connect the high pressure line to the underwater air valve assembly of this invention.
Figure 8:
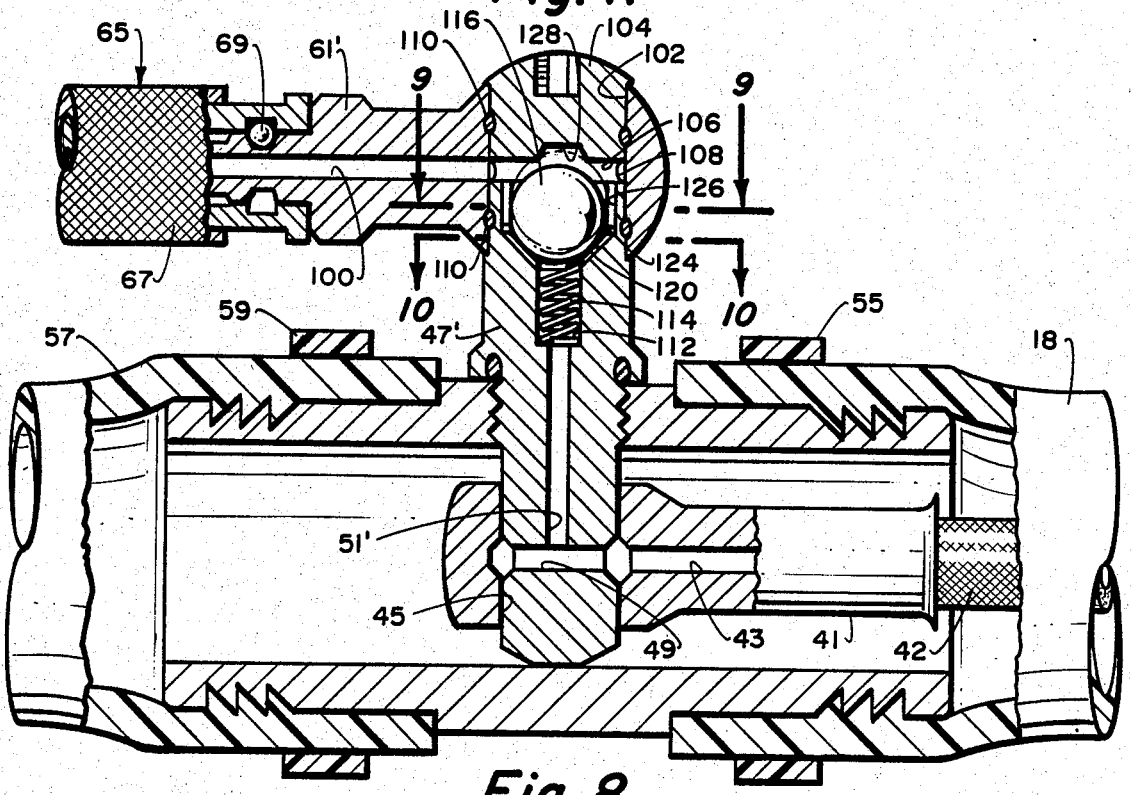
FIG. 8 is a cross-sectional view taken along line 8—8 of FIG. 7.
Figure 9:
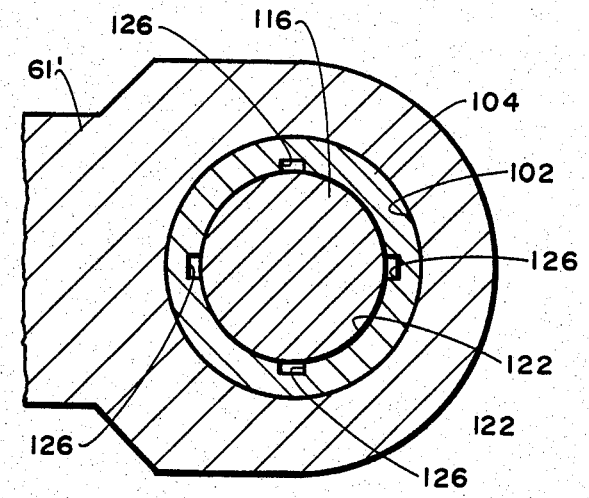
FIG. 9 is a cross-sectional view taken along line 9—9 of FIG. 8.
Figure 10:
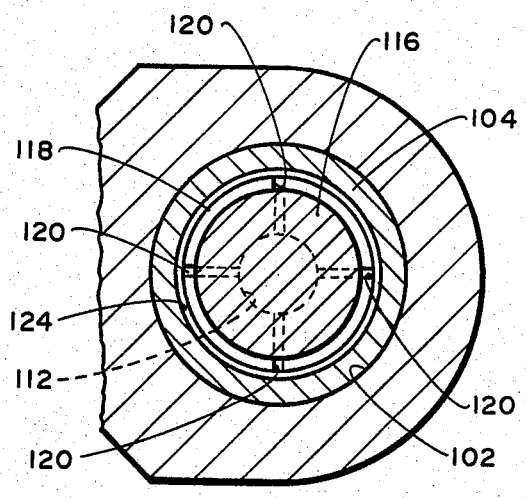
FIG. 10 is a cross-sectional view taken along line 10—10 of FIG. 8.

Referring particularly to FIGS. 7 to 10 of the drawings, there is shown such a restrictor arrangement incorporated within the fitting 47'. Like numerals have been utilized within like parts in comparing the structure of FIGS. 7 and 10 to that of FIGS. 5 and 6.

High pressure gas is conducted through the hose 67 and into passage 100 of the sleeve 61'. The sleeve 61' includes an enlarged aft opening 102. Extension 104 of the plug 47' is located within the opening 102. Passage 106 of the extension 104 connects with an annular groove 108 about extension 104. The annular groove 108 is in continuous connection with the passage 100. Appropriate sealing means in the form of upper and lower O-ring seals 110 are located between the sleeve 61' and the extension 104 in order to prevent leakage of gas therefrom.

The passage 51' located within the plug 47' connects with chamber 112. Located within the chamber 112 is a coil spring 114. Coil spring 114 is in continuous contact with a ball 116.

The ball 116 is adaped to seat against a valve seat 118 which connects with the chamber 112. Formed within the seat 118 are a plurality (four in number) of evenly spaced-apart grooves 120.

The ball 116 is located in a close conforming manner within a chamber 122. At the connection of the chamber 122 to the valve seat 120 there is located an annular groove 124. Formed within the wall of the chamber 122 are a plurality (four in number) of evenly spaced-apart grooves 126. It is to be noted that the grooves 120 are significantly smaller in size than the grooves 126.

The ball 116 is to be lineally movable within the chamber 122 a limited amount. This movement is defined as being in contact with seat 118 or the ball 116 being in contact with recess 128 formed within extension 104. Recess 128 also connects with passage 106.

The operation of the restrictor shown in FIGS. 7 to 10 is as follows: With high pressure gas being conducted to the passage 100, such high pressure will be applied against ball 116 and will maintain the ball 166 in contact with the seat 118. As a result, the high pressure gas is conducted through the grooves 126 and then through the smaller grooves 120, through the chamber 112 to passage 51'. The volume of the gas that is conducted into the passage 51' has been decreased because of the restrictive nature of the passage 120. However, because the source (not shown) of the pressurized gas is at or near maximum volume level, and also a higher pressure, a sufficient amount of gas is supplied to the passage 51'.

Upon the gas within the source reaching or being near the minimum volume level, it is necessary that a greater volume of pressurized gas be conducted into passage 51'. Because gas at a lower pressure is being applied against the upper surface of the ball 116, the force of the coil spring 114 has been preselected so as to overcome the pressure being applied to the upper surface of the ball 116 causing the ball 116 to be moved against the recess 128. As a result, the restrictive nature of the passage 120 has been eliminated and the gas is able to pass through the grooves 126, across the entire valve seat 118 into the chamber 112 and hence into passage 51'. Therefore, a larger volume of gas is being conducted into the passage 51', such volume only being limited by the combined cross-sectional area of the grooves 126.

What is claimed is:

1. An underwater air valve assembly comprising:

a housing, said housing having an internal chamber, a pressure gauge being attached to said housing;

a hose having an elongated enclosed chamber, said hose being attached to said housing, said elongated enclosed chamber connecting with said internal chamber;

a conduit having an inner end and an outer end, said conduit containing pressurized air, said conduit being located within said hose, one inner end of said conduit being connected to said pressure gauge, said pressure gauge to display a representation of the pressure of the pressurized air within said conduit; and a first valve assembly mounted within said housing, said first valve assembly being connected to said conduit, said first valve assembly being movable between a first closed position and a first open position, said first closed position preventing conducting of air from said conduit into said internal chamber, said first open position permitting conducting of air into said internal chamber, the at rest position of said first valve assembly being at said first closed position.

2. The underwater air valve assembly as defined in claim 1 including:

a second valve assembly mounted within said housing, said second valve assembly being connected to said internal chamber, said second valve assembly being movable between a second closed position and a second open position, said second closed position preventing conducting of air from said internal chamber into the ambient, said second open position permitting conducting of air between the ambient and said internal chamber, the at rest position of said second valve assembly being at said closed position.

3. The underwater air valve assembly as defined in claim 2 wherein:

said housing including an air passage, said air passage connecting to said internal chamber through said second valve assembly, the second open position being defined as a partially open position and a completely open position, with said second valve assembly in said completely open position pressurized air from the ambient can be supplied through said air passage into said internal chamber and hence into said hose, with said second valve assembly in said partially open position pressurized air is to be conducted from said hose through said internal chamber and into the ambient.

4. The underwater air valve assembly as defined in claim 3 wherein:

said housing including an oral inflation mouthpiece adapted to closely conform to the mouth of a human being, said oral inflation mouthpiece connecting with said air passage.

5. The underwater air valve assembly as defined in claim 1 including:

a depth gauge being attached to said housing, said depth gauge being spaced from said pressure gauge.

6. The underwater air valve assembly as defined in claim 2 wherein:

said second valve assembly being spaced from said first valve assembly.

7. The underwater air valve assembly as defined in claim 1 wherein:

said outer end of said hose being attached to a sleeve, a swivel fitting attached to said sleeve, said swivel fitting being connected to said conduit.

8. The underwater air valve assembly as defined in claim 7 wherein:

said swivel fitting including a restricted passage assembly.

9. The underwater air valve assembly as defined in claim 8 wherein:

said restricted passage assembly including a restrictor valve assembly, said restrictor valve assembly includes a spring biased ball being movable between a first position and a second position, with said ball in said first position a minimal volume of gas is conducted within said conduit, with said ball in said second position the maximum volume of gas is conducted into said conduit.

* * * * *